United States Patent [19]

Schwär

[11] Patent Number: 4,669,223

[45] Date of Patent: Jun. 2, 1987

[54] SUPERFINISHING AND GRINDING MACHINE FOR SHAFTS AND THE LIKE

[75] Inventor: Rudolf Schwär, Wuppertal, Fed. Rep. of Germany

[73] Assignee: Maschinenfabrik Ernst Thielenhaus GmbH, Wuppertal, Fed. Rep. of Germany

[21] Appl. No.: 918,569

[22] Filed: Oct. 14, 1986

Related U.S. Application Data

[63] Continuation-in-part of Ser. No. 726,584, Apr. 23, 1985, abandoned.

[30] Foreign Application Priority Data

Apr. 27, 1984 [DE] Fed. Rep. of Germany ..... 3415689

[51] Int. Cl.[4] ..... B24B 5/42

[52] U.S. Cl. ..... 51/95 R; 51/232; 409/165

[58] Field of Search ..... 51/34 K, 95 R, 95 GH, 51/95 WH, 95 LH, 95 TG, 123 R, 144, 232, 237 R, 237 CS; 409/162, 165

[56] References Cited

U.S. PATENT DOCUMENTS

| | | | |
|---|---|---|---|
| 1,198,614 | 9/1916 | Bright | 51/95 R |
| 1,873,752 | 8/1932 | Fraser | 51/237 R |
| 3,331,164 | 7/1967 | Winer | 51/144 |
| 3,646,710 | 3/1972 | Flohr, Jr. et al. | 51/237 CS X |

FOREIGN PATENT DOCUMENTS

| | | | |
|---|---|---|---|
| 2021454 | 12/1979 | United Kingdom | 51/95 TG |

*Primary Examiner*—Robert P. Olszewski

*Attorney, Agent, or Firm*—Karl F. Ross; Herbert Dubno

[57] ABSTRACT

A fine grinding machine for crankshafts, camshafts and the like, has a fixed headstock housing in which the spindle carrying the workpiece chuck is rotatable and axially reciprocatable. The chucking action is effected by an axial displacement of the spindle by a setting mechanism which acts upon the spindle via the same member as that which transmits the axial reciprocation thereto for the oscillating drive. A flexible connection in the rotating drive permits the axial movement.

9 Claims, 7 Drawing Figures

FIG. 2
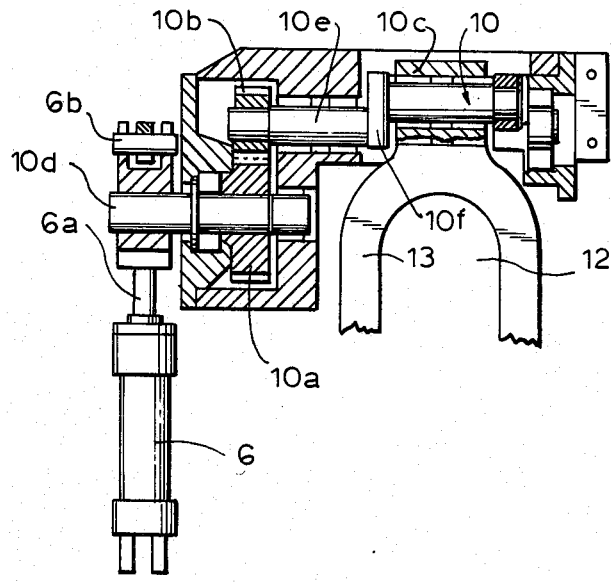
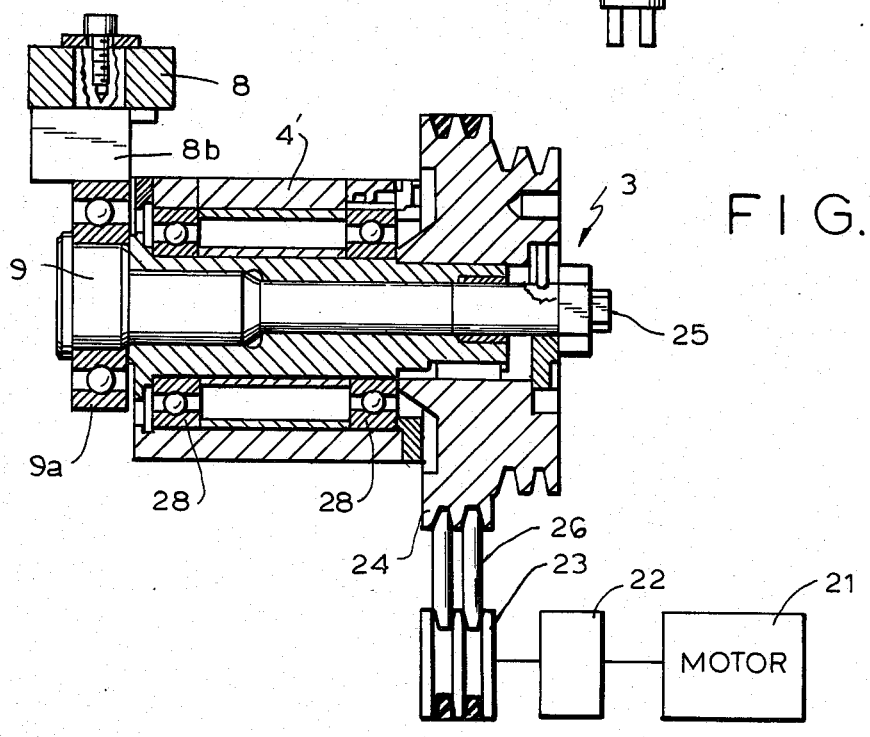
FIG. 3
FIG. 4
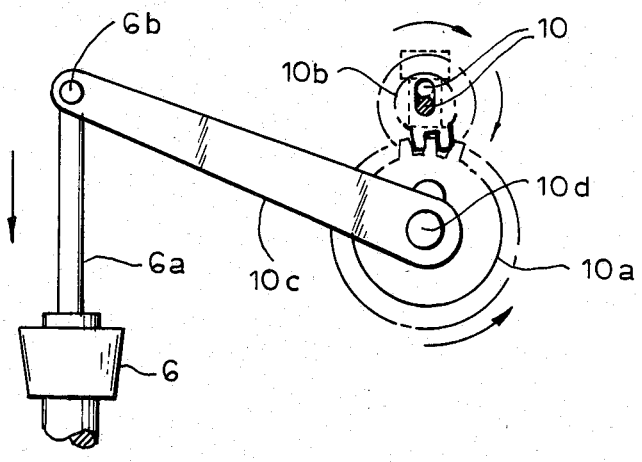

SUPERFINISHING AND GRINDING MACHINE FOR SHAFTS AND THE LIKE

CROSS REFERENCE TO RELATED APPLICATION

This application is a continuation in part of Ser. No. 06/726,584, filed 23 April 1985 now abandoned.

FIELD OF THE INVENTION

My present invention relates to a grinding machine for shafts and the like, especially camshafts, crankshafts and similar workpieces and, more particularly, a superfinishing or grinding machine which is capable of axially reciprocating the workpiece while rotating same in a finishing operation.

BACKGROUND OF THE INVENTION

Superfinishing and grinding machines for crankshifts, camshifts and the like articles are known to enable the abrasive finishing of the running surfaces of such workpieces utilizing an action which combines rotation of the workpiece and a linear reciprocation thereof in the axial direction.

To this end conventional machines for this purpose can comprise a chuck or other device for securing the workpiece at one end to a spindle, means for rotating the spindle and an oscillating drive for imparting the axial reciprocation to the workpiece. A tool holder generally is provided with a number of stones which engage the workpiece as the tools for effecting the finishing operation.

The chuck spindle can be mounted in a spindle stock or head and generally means can be provided, not only for axially reciprocating the spidnle shaft, but also for setting the axial stroke of the spindle shaft necessary for receiving and removing the workpiece.

The spindle sleeve can cooperate with a stirrup-shaped member to effect the oscillating drive in the axial direction.

The spindle stock (headstock) is generally a slide which is guided on a track or bed and also carries the oscillating drive. The slide can generally be displaced for the aforementioned clamping stroke or setting stroke. The mechanism for the setting stroke does not operate directly upon the spindle shaft, therefore, but rather acts upon the slide. During the setting stroke, the oscillating drive is entrained as well.

The slide can generally also be raisable and lowerable for receiving the workpiece.

When the fabrication tolerances are extremely narrow and great precision in finishing the workpiece is desired, the conventional grinding machine of the aforedescribed type is frequently unsatisfactory because its precision is insufficient.

Part of the problem is the fact that there are two distinct tolerances which have to be taken into consideration, namely, the guide tolerances of the oscillatingly movable spindle shaft during the oscillating operation and the guide tolerances of the spindle stock sliding in its guide. Because these tolerances are statically additive, this system is largely unsatisfactory.

OBJECTS OF THE INVENTION

It is the principal object of the present invention to provide an improved fine grinding machine for the purposes described which, however, will obviate the disadvantages set forth.

Another object of this invention is to provide a fine grinding machine with improved accuracy and precision.

Yet another object of my invention is to extend the principles of my above-mentioned copending application.

SUMMARY OF THE INVENTION

These objects are attained, in accordance with the invention, by providing the setting mechanism for the chucking stroke so that it acts upon a common member which is displaced by the oscillating and the setting stroke and then will act directly upon this spindle as does the oscillating drive, the spindle stock or head being axially fixed on the machine frame.

According to the invention, the oscillating drive can comprise a lever, one lever arm of which is acted upon by an oscillating eccentric, the lever being fulcrumed at an end opposite that at which the eccentric acts and which is provided at this end with a setting mechanism which is able to shift the fulcrum relative to the point of attack of this lever on the spring being intermediate to these ends.

The means for shifting the fulcrum can also be relatively simple and can include a crankshift which is rotated by a lever mechanism.

The rotational drive for the spindle can include a flexible member, e.g. in the form of a belt coupling a pulley on the spindle with a pulley of a drive motor.

The fine grinding machine of the invention, by comparison with earlier means for a similar purpose, is comparatively simple and, even more important, has been found to be extremely precise in the operational effect, presumably because the setting movement or the oscillation or reciprocating movement are applied via the same manner, i.e. the lever, directly to the shaft so that the stock (headstock) need not be movable.

Since two separate guides and displacement systems are not provided, the adjustment defects are no longer additive.

BRIEF DESCRIPTION OF THE DRAWING

The above and other objects, features and advantages will become more readily apparent from the following description, reference being made to the accompanying drawing in which:

FIG. 2 is a section taken generally along line II—II of FIG. 1;

FIG. 3 is a section taken generally along the line III—III of FIG. 1;

FIG. 4 is a diagram showing the mechanism of FIG. 2 from a side;

SPECIFIC DESCRIPTION

Figure 1:
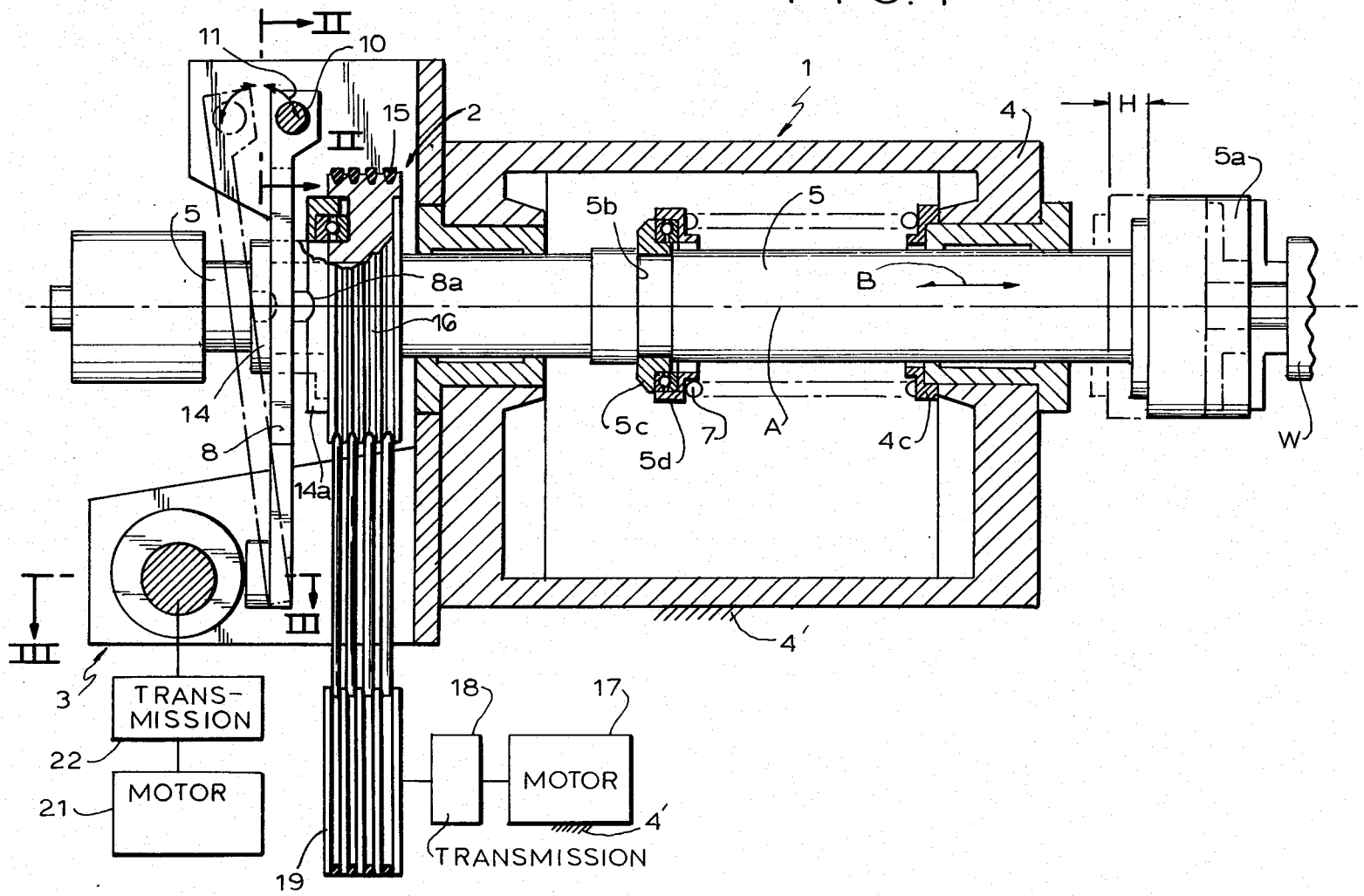
FIG. 1 is an axial section through the headstock of a fine-grinding machine according to the invention, illustrated in highly diagrammatic form.

The apparatus shown in the drawing is intended for the fine-grinding or finishing of shafts, especially crankshafts, camshafts and similar workpieces as represented at W.

The apparatus comprises the headstock shown at 1 and a rotation drive generally represented at 2 for rotating the workpiece about an axis A, and oscillating drive 3 for reciprocating the workpiece axially in the direction represented by the arrow B and a tool holder represented at T in a highly diagrammatic form.

Figure 5:
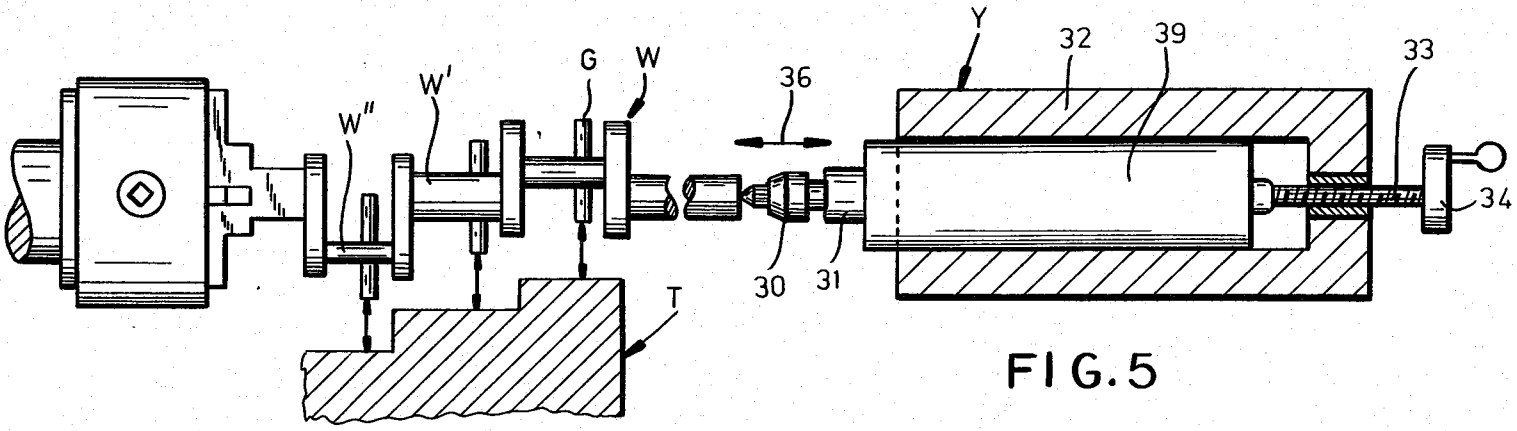
FIG. 5 is a diagrammatic elevational view, partly broken away, showing additional parts of the machine.

As can be seen from FIG. 5, the tool holder is positioned between the headstock 1 and the tailstock Y (see FIG. 7), and is formed with grinding tools G which engage the positions W' and W'' of the crankshaft W to the ground. The number of grinding tools, therefore, corresponds to the number of the camshaft or the number of crank pins of the crankshaft to be ground.

The headstock 1 is provided with a headstock housing represented at 4 which is axially fixed on the body of the machine which has been represented at 4'.

The tailstock and tool holder can be mounted on body 4' as well in a conventional manner.

The rotational drive 2 comprises a pulley 16 which is keyed and axially fixed to a spindle 5 extending along the axis A and connected by V-belts 15 flexibly to a drive pulley 19 of an electric motor 17 connected by a transmission 18 with the pulley 19. The motor and transmission can likewise be mounted upon the machine body 4'.

The oscillating drive 3 can also have an electric motor 21 and a transmission 22 mounted on the machine body and connected to a shaft 25 by a V-belt pulley 24 whose belts 26 pass around a sheave 23 connected to the transmission 22.

The spindle 5 carries a chuck **5*a*** in which the end of the workpiece is clamped.

The spindle shaft 5, in addition to its oscillating stroke, has a setting stroke which allows it to be advanced to engage the workpiece in the chuck or retract it to allow the workpiece to be withdrawn from the chuck while maintaining the headstock stationary. This stroke is represented at H.

To this end a setting mechanism is provided. The setting mechanism can comprise a cylinder 6, e.g. a pneumatically operated piston and cylinder arrangement, whose piston rod **6*a* is pivotally connected at 6*b* (see FIGS. 2 and 4) to a lever 1O*c* driving a shaft 10*d* which rotates a gear 10*a*. The gear 1O*a* meshes with a gear 10*b* which is rigid with a crankshaft 10*e* whose crank pin 10*f* is an eccentric represented at 10 which can form a fulcrum of a lever 8 and can be shifted by actuation of the double acting cylinder 6 through the stroke represented by the arrow 11 in FIG. 1 to effect the retraction H in FIG. 1** as previously described or conversely, a corresponding advance to receive the workpiece.

The member 8 bears upon a spindle sleeve 14 at its slider **14*a* via a pair of studs 8*a* and is a member common not only to the setting mechanism 6, 10, etc., but also to the oscillating drive represented at 3**.

More particularly, the oscillating drive comprises an eccentric which carries a ball bearing roller **9*a* and is driven by the shaft 25 journaled in bearings 26 on the machine housing 4' and keyed to the sheave 23 previously described. A cam-follower pad 8*b* of a low-friction wear-resistant material is carried by the lever 8**.

The fulcrum 10 of the lever 8 is thus in its right-hand position for normal oscillating drive and grinding operations.

To retract the chuck, however, the lever 8 which is in the form of a fork or stirrup 14, having an elongated opening through which the spindle 5 passes, is swung through its upper deadpoint position at 180° into the dot-dash line position shown. For this stroke, of course, the pulley 16 is drawn to the left (FIG.1), a displacement permitted by the flexible belt coupling 19.

The spindle 5 is formed with a groove **5*b* in which a ring 5*c* is lodged to form a shoulder against which a thrust bearing 5*d* rests. The thrust bearing 5*d* forms one seat for a spring 7 which is seated against the housing 4 at 4*c* as can be seen in FIG. 1. The spring 7 which is a compression-type coil spring, therefore, serves to bias the spindle 5 to the left to effect displacement of this spindle in that direction when the fulcrum 10 is shifted to the left and to maintain the lever 8 pressed against the eccentric 9**.

Figure 7:
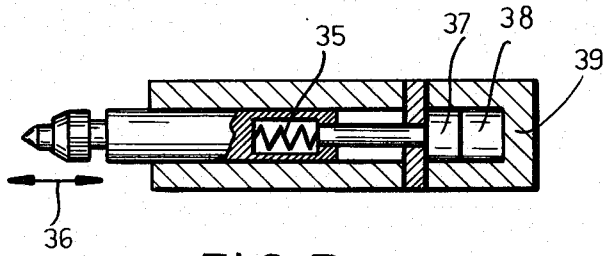
FIG. 7 is a cross sectional view through the tailstock, showing how it permits reciprocation of the headstock.
Figure 6:
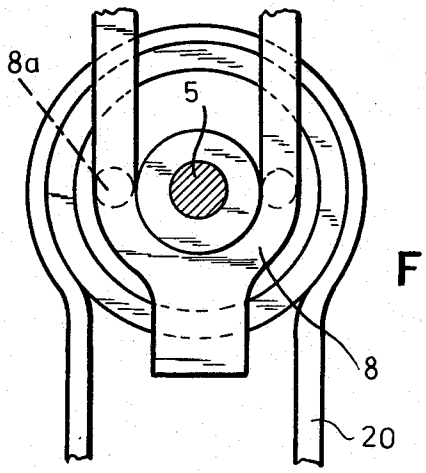
FIG. 6 is a section in the same plane as the section line II—II but illustrating another portion of the actuating lever.

As can be seen from FIG. 7, the tailstock Y can include a center 30 on a support 31 which can initially be positioned in the housing 32 by a threaded spindle 33 and a handwheel 34. The support 31, in turn, can be biased by a spring 35 in the direction of the headstock so that upon generation of the workpiece oscillations in the manner described, the center 30 of the tailstock can be correspondingly displaced against the spring force as represented by the arrows 36 in FIGS. 5 and 7. The spring 35 can bear against a piston 37 which can be relieved of pressure in the cylinder 38 formed in the tubular body retraction of the center which may be required to remove the workpiece. When a new workpiece is inserted, of course, the cylinder 38 is repressurized.

I claim:

1. In a fine-grinding machine for the finishing of a workpiece such as a camshaft or a crankshaft and comprising:

a headstock, a spindle rotatably journaled in said headstock and formed with a chuck adapted to receive an end of said work piece, a rotational drive coupled to said spindle for rotating same, an oscillating drive coupled to said spindle for axially oscillating same, and means formed with a plurality of tools engaging said workpiece, the improvement which comprises:

means mounting said spindle for axial movement relative to said headstock whereby said spindle is axially reciprocated in said headstock by said oscillating drive, said oscillating drive including a member acting on said spindle and in the form of a lever having a fulcrum and said oscillating drive including an eccentric acting upon said lever;

means for fixing said headstock against axial displacement; and a setting mechanism for shifting said spindle relative to said headstock independently of said axial reciprocation, said mechanism acting upon said member, said lever having a fulcrum at one end and said eccentric acting upon an opposite end of said lever, said mechanism being constructed and arranged to shift said fulcrum generally in a direction along the axis of said spindle.

2. The improvement defined in claim 1 wherein said mechanism includes a crank having a crank pin forming said fulcrum.

3. The improvement defined in claim 2 wherein said rotational drive includes a drive motor and means forming a flexible connection between said drive motor and said spindle.

4. The improvement defined in claim 3 wherein said spindle is provided with a V-belt pulley, said motor is provided with a V-belt pulley and said means providing said flexible connection includes one V-belt connecting said pulleys.

5. The improvement defined in claim 4 wherein said crank is connected to a lever actuated by a fluid-operated cylinder.

6. The improvement defined in claim 5 wherein the lever connected to said crank is operatively connected to said crank by a pair of meshing gears.

7. The improvement defined in claim 6 wherein said eccentric is provided with a V-belt pulley, said oscillating drive including a further motor and V-belt pulley, the last mentioned V-belt pulley being connected by at least one V-belt to the V-belt pulley connected to said eccentric.

8. The improvement defined in claim 7, further comprising a spring bearing upon said spindle in a direction opposite that in which said member acts upon said spindle.

9. The improvement defined in claim 8 wherein said spindle is seated against at least one bearing in said headstock.

* * * * *